US006061860A

United States Patent [19]

Fitzgerald

[11] Patent Number: 6,061,860

[45] Date of Patent: May 16, 2000

[54] HYDRAULIC POWERED ROTARY SCRUBBING BRUSH FOR SWIMMING POOLS

[76] Inventor: Patrick John Fitzgerald, 17554 Labrador St., Northridge, Calif. 91325

[21] Appl. No.: 09/082,438

[22] Filed: May 20, 1998

Related U.S. Application Data

[60] Provisional application No. 60/047,763, May 27, 1997.

[51] Int. Cl.[7] ..... E04H 4/16

[52] U.S. Cl. ..... 15/1.7; 15/387

[58] Field of Search ..... 15/1.7, 387

[56] References Cited

U.S. PATENT DOCUMENTS

| | | | |
|---|---|---|---|
| 2,000,930 | 5/1935 | De Nagy | 15/387 X |
| 2,000,931 | 5/1935 | De Nagy | 15/387 X |
| 2,045,980 | 6/1936 | De Nagy | 15/387 X |
| 2,703,904 | 3/1955 | De Long | 15/387 X |
| 3,008,159 | 11/1961 | Del Vecchio | 15/1.7 |
| 3,471,884 | 10/1969 | Wright | 15/1.7 X |
| 3,716,883 | 2/1973 | Monroe | 15/1.7 |
| 3,909,875 | 10/1975 | Rother et al. | 15/387 |
| 3,959,838 | 6/1976 | Hannah | 15/1.7 |
| 4,094,031 | 6/1978 | Cellini | 15/1.7 |
| 4,538,322 | 9/1985 | Ahlf et al. | 15/387 |
| 4,589,161 | 5/1986 | Kochte et al. | 15/387 X |
| 4,692,956 | 9/1987 | Kassis | 15/1.7 |
| 4,734,954 | 4/1988 | Greskkovics | 15/1.7 |
| 4,837,888 | 6/1989 | Maier | 15/387 |
| 5,044,034 | 9/1991 | Iannucci | 15/1.7 |
| 5,093,950 | 3/1992 | Heier | 15/1.7 |

*Primary Examiner*—Mark Spisich

[57] ABSTRACT

A compact assembly (40) with a turbine (20) fixed to a rotating drive shaft (22) with an extensible joint connected to small brush (38) by a shaft on the brush (36). The assembly (40) is inserted into a standard pool vacuum head (50) suction cavity (52) to provide a localized scrubbing action. The brush (38) is powered by the water pulled through the suction cavity (52) in the vacuum head (50) driving the turbine (20) causing rotation of the drive shaft (22) and brush shaft (36). The brush (38) is mounted to the end of the brush shaft (36). A spring (34) that is placed coaxial about the brush shaft (36) holds the brush (38) in contact with the surface (70) being scrubbed clean.

7 Claims, 4 Drawing Sheets

HYDRAULIC POWERED ROTARY SCRUBBING BRUSH FOR SWIMMING POOLS

A description of this device has been filed with the United States Patent and Trademark Office pursuant to 35 U.S.C. ss 119(e)(i), and priority of provisional patent application Ser. No. 60/047,763 filed May 27, 1997 is claimed.

BACKGROUND—FIELD OF THE INVENTION

This invention relates to the cleaning of the bottom of swimming pools, specifically a hydraulic powered scrubbing brush designed to perform spot scrubbing of localized spots and other surface discoloration.

BACKGROUND—DESCRIPTION OF PRIOR ART

The best way to remove alga is to scrub it from the plaster surfaces of the pool. Chemicals added to kill the algae are expensive and require several days to work effectively. Chemicals can add odors and a metallic taste that remain in the water for extended periods of time. After the chemicals have killed the algae the dead algae must be brushed from the plaster surface of the pool and the residue vacuumed up to remove it from the water. Brushing is an immediate response to the algae problem that provides effective removal of the algae, however as with the chemicals the residue must be vacuumed up to remove it from the water.

There are two methods to brush the plaster surfaces of a pool. First, a small spot brush is mounted on the end of a long pole. Then, standing on the deck, the long pole with the brush on the end is used to scrub the algae. This method is effective but, due to the length of the pole, significant leverage is lost. This method is also physically demanding. The second method uses the same brush but it is detached from the pole and hand held. Here a person must dive to the bottom of the pool to scrub the local area covered with the algae. This method is very effective but limited to the physical endurance of the diver, how long they are able to hold their breath under water. A drawback to this method is the loss of leverage due to the natural buoyancy of the human body. This combined with the force applied while scrubbing tends to push the diver away from the algae spot. Significant leg kicking action is required by the diver to develop the required scrubbing forces. This method is more physically demanding than the first and can be seasonally constrained due the temperature of the water in the pool.

As an alternative to the these manual or chemical methods a powered device was sought. The desired device would not contaminate the water or pose an electrical safety hazard, and could be operated from the deck surrounding the pool.

Several inventions have been developed to try to deal with this problem. U.S. Pat. No. 5,044,034 to lannucci (1991) discloses a dedicated device with a large housing encompassing a rotating scrubbing brush. While this device can clean small particles its design does not permit leaves or other larger objects to pass through the brush mechanism. The brush is large and not capable of reaching the algae in small spaces.

U.S. Pat. No. 4,734,954 to Greskovics (1987) discloses a device powered by a water source external to the existing pool circulation pump. This device also has no provision to remove the material it might remove or loosen from the pool surface. It would dislodge the material and then stir it into the rest of the water.

U.S. Pat. No. 4,692,956 to Kassis (1985) discloses a device that stirs the water to agitate the local surface. This device does not embody rigid bristles that engage the plaster pool surfaces to provide scrubbing action.

U.S. Pat. No. 4,094,031 to Cellini (1978) describes a device with fixed brushes requiring the same mechanical motion as a fixed brush on a pole.

These devices either compromise the vacuum source or do not provide a vacuum source to remove the materials dislodged from the surfaces of the plaster. Thus material scrubbed from the plaster surface is left in the water and must be removed in secondary vacuuming operation. The devices that are vacuum powered utilize brushing mechanisms that are rather large compared to the available power to drive the mechanism and the brush area precludes reaching small irregularities in the plaster surface. These devices also utilize rather large parasitic gear trains dedicated to their singular scrubbing function. There is no provision to be able to use the vacuum without operating the scrubbing mechanism, thus reducing the vacuum's efficiency.

SUMMARY OF THE INVENTION

The hydraulically powered spot scrubber is a compact device that is inserted into the existing suction port of a standard vacuum head. This implementation utilizes the inlet port of a standard vacuum head to direct the fluid flow through the small axial turbine assembly. Thus the bulky housings' characteristic of the prior art are eliminated. The axial turbine extracts work from the moving fluid in the vacuum flow stream and couples rotational force to the attached drive shaft. Thus as the working fluid passes through the turbine the turbine will rotate the drive shaft. The drive shaft coupled to the brush by means that enables the driven brush to rotate freely but translate linearly along the axis of the shaft assembly. In this manner the rotating brush is capable of self adjusting to small irregularities in the plaster pool surface. The axial translation is augmented by a spring. Thus the spring loaded brush is held in contact with the plaster surface. The turbine-brush assembly is held in place by the suction force present in the inlet chamber of the vacuum head. When normal vacuuming is desired the turbine-brush assembly can easily be removed by simply pulling it out of the inlet chamber of the vacuum head. Thus as the unit is scrubbing the algae from the plaster surface the debris is pulled directly into the vacuum chamber and delivered with the rest of the water for filtering. The size and design of the turbine assembly permit small leaves and other objects to freely pass through the suction port.

In the event that material does become fouled in the brush or the turbine, the unit can easily be removed from the suction inlet. No further disassembly is required for cleaning. The obstruction is permitted to pass through the suction port and then the turbine-brush assembly is reinserted into the vacuum head.

The design of the turbine-brush assembly permits the fluid flow to be reversed and the function of the unit, the brushing action, is unchanged. Thus the same turbine-brush assembly can be used with either suction or pressure. In this embodiment the spring force is augmented by the pressure created by the flow stream. Thus the spring can be eliminated and the fluid flow will hold the brush in contact with the plaster surface of the pool.

OBJECTS AND ADVANTAGES

Several objects and advantages of the present invention are:

(a) provides scrubbing applied directly to a localized area combined with the suction of the vacuum head to instantly remove the debris scrubbed loose;

(b) provides a compact unit with brush height adjustment that can be used with existing vacuum heads without modification to the vacuum head;

(c) the compact size of the brush head enables the unit to get into smaller irregularities in the surface and better follow the transitions from the side of the pool to the floor of the pool;

(d) provides a spring loaded brush design which enables the brush to maintain better contact with the surface and negotiate irregularities in the surfaces and;

(e) the efficient direct drive design eliminates the parasitic gear trains and extraneous housings that are associated with the prior art.

DRAWING FIGURES

REFERENCE NUMERALS USED IN THE DRAWINGS

| | |
|---|---|
| 10 nut | 12 washer |
| 14 upper sleeve bearing | 16 upper spider |
| 18 thrust bearing | 20 turbine |
| 21 set screw | 22 drive shaft |
| 23 thread on drive shaft | 24 pin |
| 26 drive slot | 27 counter bore in drive shaft |
| 28 lower sleeve bearing | 30 lower spider |
| 32 collar | 33 set screw |
| 34 spring | 36 brush shaft |
| 38 brush | |
| 40 hydraulic powered rotary scrubbing brush assembly | |
| 50 vacuum head assembly | 52 suction cavity |
| 54 suction cavity opening | |
| 60 suction hose | 70 plaster surface |

DETAILED DESCRIPTION OF DRAWINGS 1 TO 6

Figure 4:
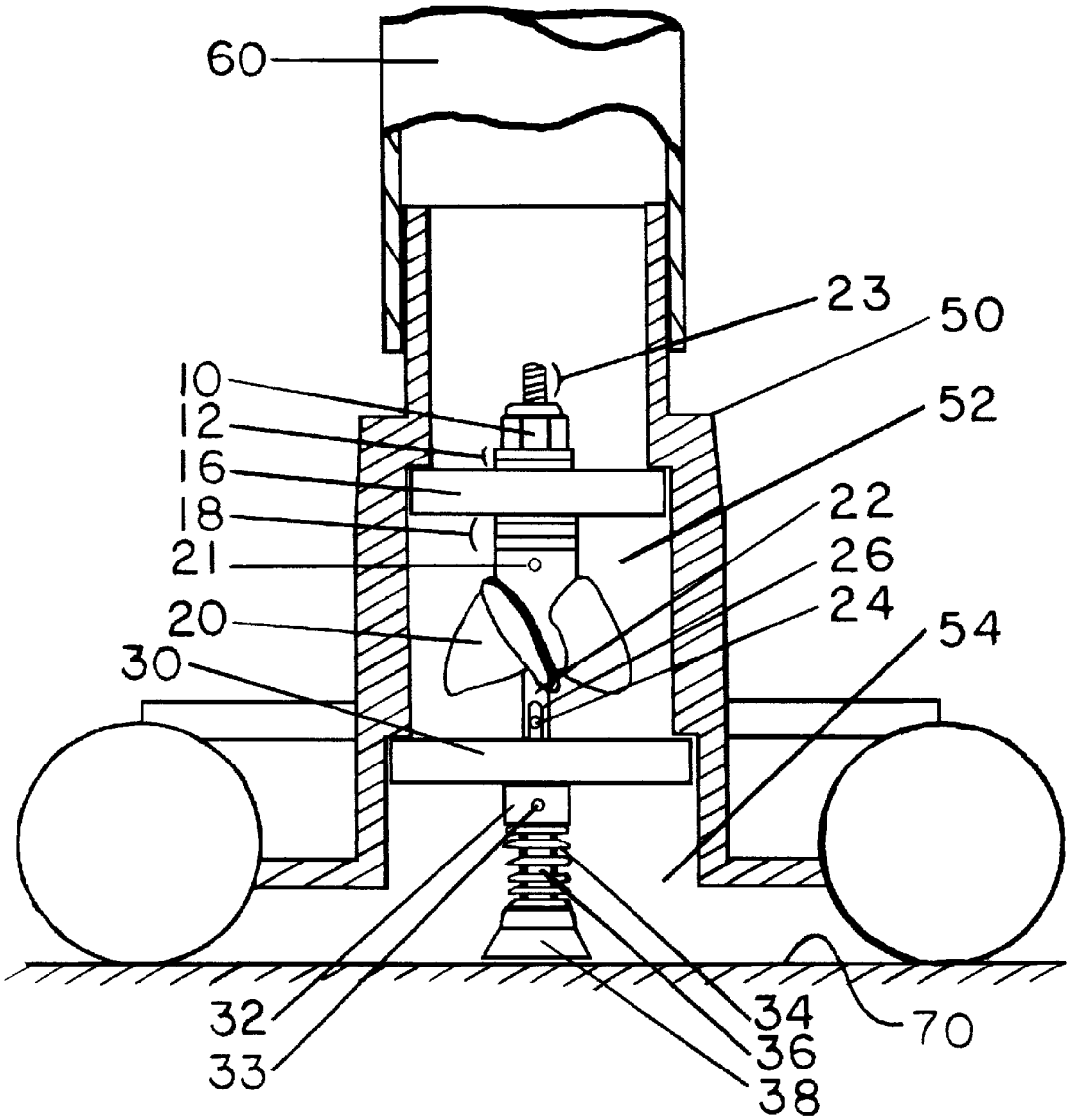
FIG. 4 is a sectioned view of a typical installation in pool vacuum head. The vacuum head has been cut away to clearly show the easy installation of the hydraulic powered rotary scrubbing brush assembly.

Using the numerical references provide on the drawings. FIG. 4 depicts a hydraulic powered rotary scrubbing brush referred to as 40 which is inserted into the suction cavity 52 of a vacuum head assembly 50. Fluid is drawn through the suction cavity opening 54, passing through the suction cavity 52 and into a suction hose 60. The vacuum head assembly 50 and the suction hose 60 are shown for reference only and are not the subject of this patent. Thus the working fluid is directed through the turbine 20 of hydraulic powered rotary scrubbing brush 40, by use of the suction cavity 52 that is provided by the vacuum head 50, causing said turbine 20 to rotate.

Figure 1:
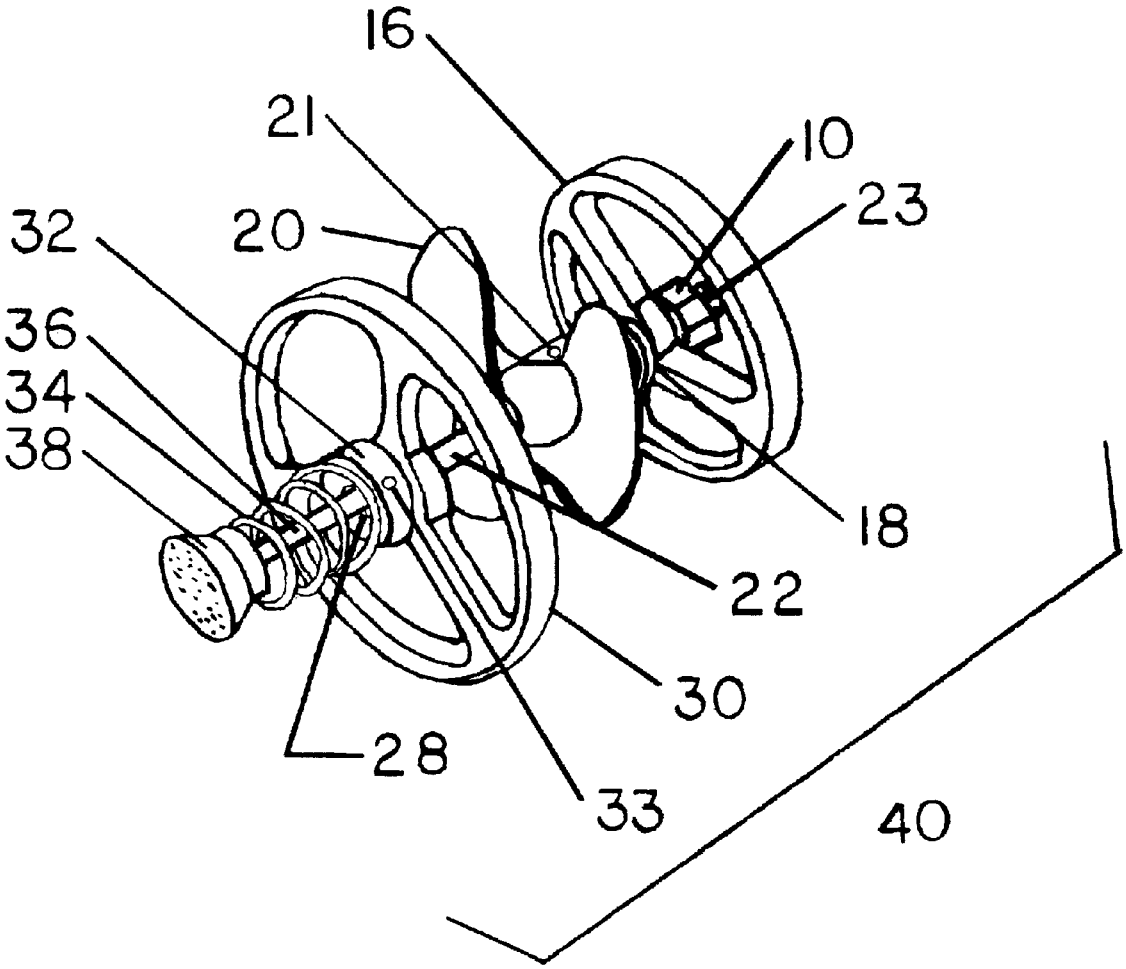
FIG. 1 is a perspective view of the hydraulic powered rotary scrubbing brush for swimming pools looking from the bottom to the top.
Figure 2:
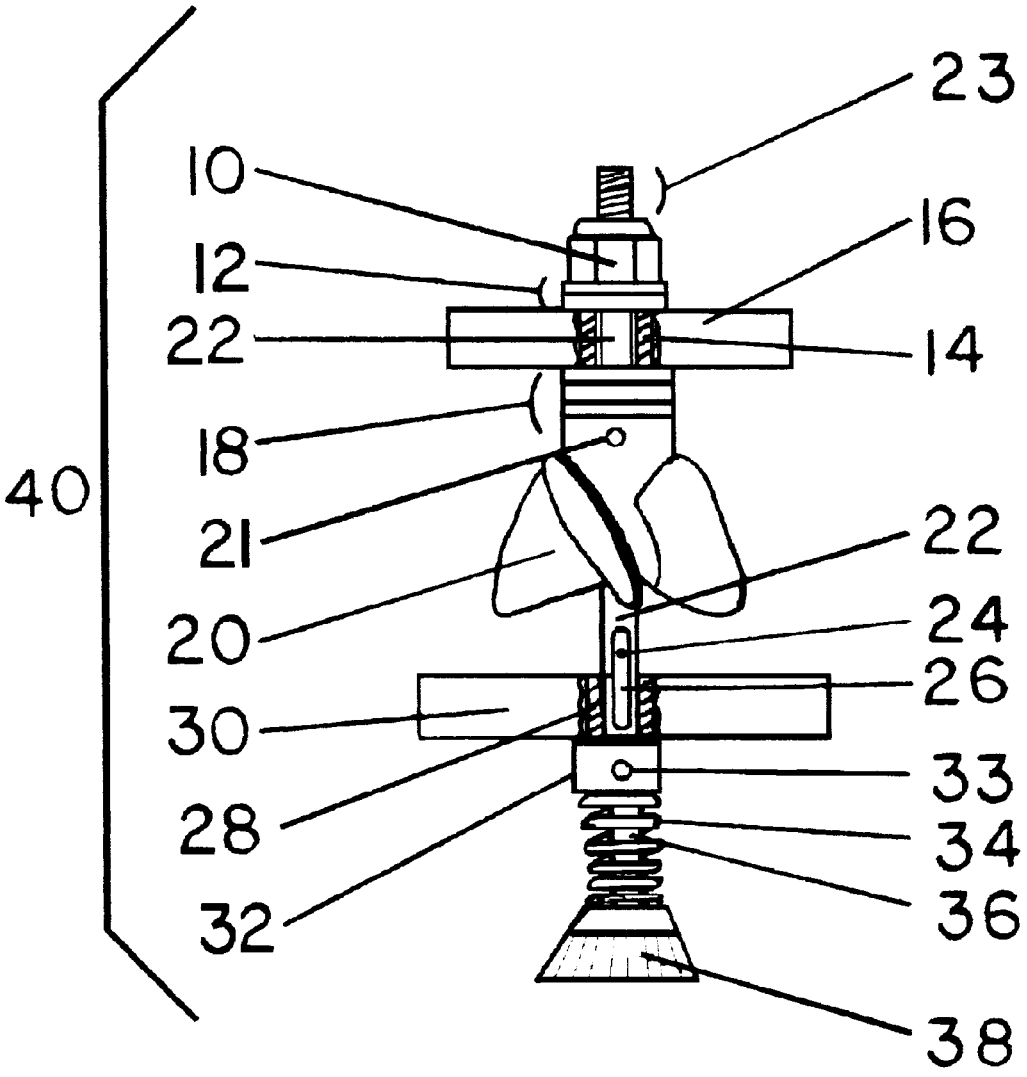
FIG. 2 is an elevation view.

Refer to the hydraulic powered rotary scrubbing brush referred to as 40 in FIG. 2. The turbine 20 is rigidly coupled to a drive shaft 22 by a set screw 21, thus rotation of said turbine 20 causes the rotation of drive shaft 22. The drive shaft 22 is connected to a brush shaft 36 by means of an extensible torque transmitting coupling. In this embodiment the extensible torque transmitting coupling is achieved by a pin-slot arrangement. A counter bore 27 and a slot 26 in the drive shaft 22 provide a means for the pin 24 and the brush shaft 36, into which pin 24 pressed, to telescope axially relative to the drive shaft 22. Torque is still transmitted from the drive shaft 22 to the brush shaft 36. Thus, rotation of the drive shaft 22 results in rotation of the brush shaft 36 that has a brush 38 on the end of said shaft 36. Thus, the brush 38 that is mounted on said brush shaft 36 can also travel relative to said drive shaft 22 by means of the pin slot joint described. The telescoping pin-slot arrangement is a means of creating extensible torque transmitting coupling. One skilled in the art could conceive of other methods of extensible torque transmitting couplings such as a splined coupling, bellows or other means.

Refer to the hydraulic powered rotary scrubbing brush referred to as 40 in FIG. 2. A spring 34 is located around the brush shaft 36 and compressed between the brush 38 and a collar 32 of the lower spider 30. Thus the brush 38 is held in the extended position by means of the spring 34. The spring provides a means for the extensible torque transmitting coupling to extend thus maintaining the brush 38 in positive contact with the plaster surface 70 being cleaned. One skilled in the art could conceive of other means of spring loading the extensible torque transmitting couplings such as spring bellows, spring shafts or use of the hydraulic flow stream itself.

Figure 3:
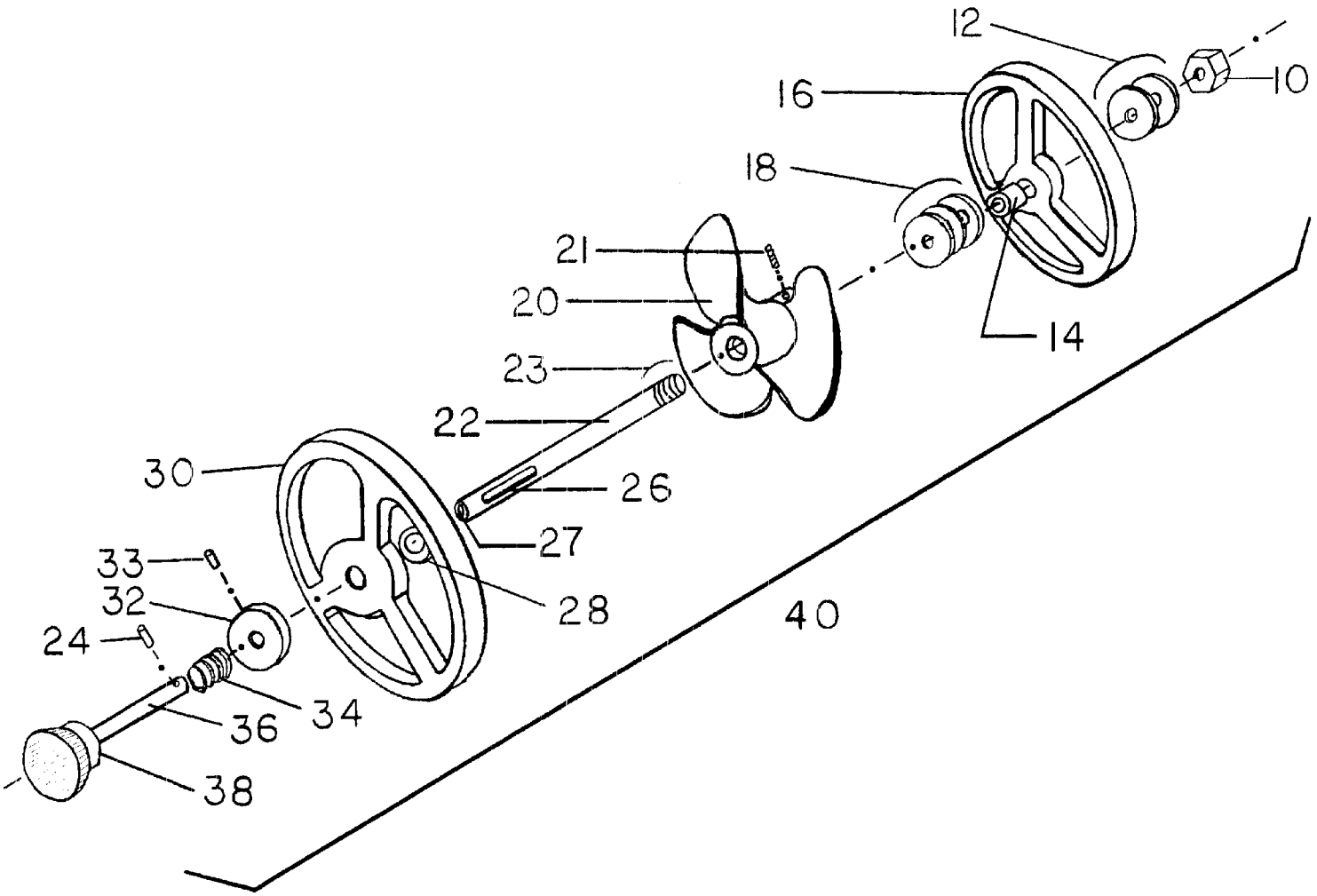
FIG. 3 is and exploded view of the elevation view in FIG. 2.

Refer to FIG. 4, the hydraulic powered rotary scrubbing brush 40 maintains its position in the fluid flow of the suction cavity 52 by means of an upper spider 16 and a lower spider 30. Referring to FIG. 2 and FIG. 3, these spiders 16 and 30 provide the means to locate the rotating assembly in the middle of the flow stream by an upper sleeve bearing 14 and a lower sleeve bearing 28. Referring to FIG. 3, the upper sleeve bearing 14 located in the upper spider 16 provides a rotational guide for the drive shaft 22. The lower sleeve bearing 28 located in the lower spider 30 provides a rotational guide for the drive shaft 22. Refer to FIG. 4, the location of the spiders 16 and 30 along the axis of the drive shaft can be adjusted as required to achieve a proper fit in the vacuum head 50. A nut 10 and the collar 32 locate the spiders along the axis of the drive shaft 22. The nut 10 and the collar 32 are adjustable thus providing a means to change the location of the spiders 16 and 30 along the axis of the drive shaft 22.

Refer to FIG. 2, the nut 10 is attached to the drive shaft 22 by a threaded interface. The drive shaft 22 is threaded 23 at the end which passes through the upper spider 16. Adjustment of the nut 10 translates the drive shaft 22 up and down relative to the spider 16. The thrust washer 12 is located between the nut 10 and the upper spider 16. This arrangement provides a means of locating the drive shaft 22 axially, relative to the upper spider 16 while letting said nut 10 rotate freely with the drive shaft 22, relative to the upper spider 16. Referring to FIG. 4, the drive shaft 22 is coupled to the brush shaft 36 which is coupled to the brush 38, by means previously described. Thus axial adjustment of the drive shaft 22 provides a means to axially adjust the brush 38 relative to the plaster surface 70. A thrust washer 18 is located between the turbine 20 and the upper spider 16. The thrust washer 18 locates the turbine 20 along the drive shaft 22 relative to the upper spider 16. The turbine 20 is located on the drive shaft 22 such that thrust washer 18 is lightly contacting the upper spider 16. Thus the thrust washer 18 transmits the axial thrust from the turbine 20 to the upper spider 16 while permitting free rotation of the turbine 20 relative to the upper spider 16. The location of the turbine 20 is adjustable and the turbine 20 is rigidly held to the drive shaft 22 by a set screw 21.

Refer to FIG. 2, the lower spider 30 is located by the collar 32. The collar 32 is rigidly attached to the brush shaft 38 by a set screw 33. The collar 32 is located along the brush shaft 36 such that a slight clearance exists between the collar 32 and the lower spider 30. Thus the collar 32 can freely rotate relative to the lower spider 30. Reefer to FIG. 4, the lower spider 30 is permitted to seat against the inside of the suction cavity 52 in the vacuum head 50.

Refer to FIG. 4, while the two spiders 16 and 30 shown are of slightly different size this represents one embodiment of the invention. The size of spiders 16 and 30 could be changed without altering the invention at hand.

METHOD OF OPERATION

The hydraulic powered rotary scrubbing brush 40 is inserted into the suction cavity 52 of a standard swimming pool vacuum head 50. The suction is provided by a typical pool hose 60 connected to a suction source. The suction hose 60 draws the water through the suction cavity opening 54 into the suction cavity 52. The walls of the suction cavity 52 constrain the water to pass through the turbine 20 of the rotary scrubbing brush 40. The rotation of the turbine 20 causes the brush 38 to rotate by means previously described.

The vacuum head 50 is then positioned over the area to be scrubbed by the rotary scrubbing brush 38. As the vacuum head 50 is moved about the area to be cleaned, the brush 38 can translate up and down relative to the vacuum head 50. The drive shaft 22 is counter bored 27 at the end with the slot 26 such that the brush shaft 36 can telescope in and out of the drive shaft 22. The slot 26 in the drive shaft 22 provides a sliding joint for the pin 24 in the brush shaft 36 to translate along the axis of the drive shaft 22. The pin 24 couples the rotary motion from the drive shaft 22 to the brush shaft 36. The spring 34 on the brush shaft 36 provides a force which keeps the brush shaft 36 extended from the drive shaft 22. Thus the brush 38 fixed to the end of the brush shaft 36 can translate up down relative to the vacuum head 50 to better maintain contact with the surface to be cleaned.

Thus the reader has been taught how to construct a simple compact device that can scrub the surfaces in a swimming pool. While several specific examples have been used to describe this invention these descriptions are illustrative and not meant to limit the scope of the invention. For example, the turbine could be of a flat blade design or have more blades shown, the pin and slot could be a spline, or the spiders could be tapered cone structure or discrete arms reaching out to sides of the suction chamber, etc.

The scope of the invention should be determined by the claims which follow.

What is claimed is:

1. A hydraulic power rotary scrubbing brush assembly for use in a swimming pool vacuum head assembly having a first end connected to a suction hose, a suction cavity opening at a second end and a suction cavity therebetween, the rotary scrubbing brush assembly comprising:

a drive shaft including a counter bore and a slot in a lower end thereof and a threaded section on the opposite end thereof;

an upper and lower spider for supporting the drive shaft within the vacuum head assembly, said drive shaft passing through each of the spiders and being rotatable relative thereto;

a turbine fixedly secured to the drive shaft intermediate the upper and lower spiders;

a brush shaft including a brush at one end thereof and a laterally extending pin at a second end thereof, the second end of the brush shaft being located with the counter bore in the drive shaft with the pin thereof movably disposed within the slot in the drive shaft whereby the brush shaft can telescope relative to the drive shaft;

a spring between the lower spider and the brush for biasing the brush toward the surface being cleaned; and wherein the fluid drawn through the vacuum head assembly causes the turbine to rotate the drive shaft and the brush thereon.

2. The hydraulic power rotary scrubbing brush assembly of claim 1 wherein said threaded section on the drive shaft provides means for a threaded nut disposed along said threaded section whereby rotational adjustment of said nut causes said nut to translate along the drive shaft and bear against the upper spider providing means for the drive shaft to be axially adjusted relative to said upper spider.

3. The hydraulic power rotary scrubbing brush assembly of claim 2 wherein said means for axial adjustment of the drive shaft provide means for the axial position of said brush shaft and said brush connected by means to the drive shaft to change relative to the upper spider and lower spider.

4. The hydraulic power rotary scrubbing brush assembly of claim 1 wherein said scrubbing brush assembly is substantially held in place by hydraulic means of the water drawn through the vacuum head assembly impinging on said scrubbing brush assembly placed in said suction cavity of the vacuum head assembly.

5. The hydraulic power rotary scrubbing brush assembly of claim 1 wherein said scrubbing brush assembly is held in said suction cavity of said vacuum head assembly by the friction between the spiders and the inside surfaces of the suction cavity where said friction results from a close fit between the spiders and suction cavity surfaces.

6. The hydraulic power rotary scrubbing brush assembly of claim 1 wherein a thrust bearing mounted on said drive shaft is disposed between the upper spider and the turbine so that friction therebetween is substantially reduced.

7. The hydraulic power rotary scrubbing brush assembly of claim 1 wherein an adjustable locking collar is fixedly secured to the drive shaft intermediate the lower spider and spring whereby adjustment of said collar along the drive shaft provides means for adjustment of the spring biasing force.

* * * * *